United States Patent [19]

O'Steen

[11] 4,153,999

[45] May 15, 1979

[54] ARCHERY BOW SIGHTING ARRANGEMENT AND METHOD

[76] Inventor: Sonny J. O'Steen, 826 Florence Ct., Owensboro, Ky. 42301

[21] Appl. No.: 852,691

[22] Filed: Nov. 18, 1977

[51] Int. Cl.[2] ..... F41G 1/46

[52] U.S. Cl. ..... 33/265

[58] Field of Search ..... 33/265, 228; 124/87

[56] References Cited

U.S. PATENT DOCUMENTS

| | | | |
|---|---|---|---|
| 2,461,122 | 2/1949 | McQuitty | 33/265 |
| 3,355,809 | 12/1967 | Guyton | 33/265 |
| 3,568,323 | 3/1971 | Lendway | 33/265 |
| 3,854,217 | 12/1974 | Killian | 33/265 |
| 4,020,560 | 5/1977 | Heck | 33/265 |

*Primary Examiner*—Richard R. Stearns
*Attorney, Agent, or Firm*—Warren D. Flackbert

[57] ABSTRACT

An archery bow sighting arrangement and method characterized by the use of a mechanical scale for establishing the desired shooting range, the sight point being determined by the intersection of a cursor or index line and calculated scale lines representing the various range distances. The cursor line may be movable with respect to a fixed pattern of scale lines or the cursor line may be fixed and the scale lines rotatable. The invention permits the instantaneous setting of sight markings, in contrast to the present approach of separately marking a piece of tape for each distance.

6 Claims, 11 Drawing Figures

ARCHERY BOW SIGHTING ARRANGEMENT AND METHOD

As is known, the sighting of a target is an important consideration for the archer, where proper sighting is dependent upon many factors including, by way of example, the weight and length of the arrow, the kinetic energy of the bow, the shooter's body form, the size of the string, the type of release or the like. A need has arisen for an archery sighting arrangement which permits the instantaneous setting of sight markings with the preceding factors in consideration and which overcomes the presently practiced sighting technique, i.e. the manual marking of a piece of tape for each desired range distance.

The preceding objective is satisfied by the invention wherein mechanical sighting is immediately achieved through cooperation of a cursor or index line with a scale mathematically derived to represent sighting distances. One invention form utilizes a movable cursor line in combination with a fixed sight scale, while another invention form utilizes a fixed cursor line in front of a rotatable sight scale; however, the same instantaneous sighting results are accomplished with either approach.

The bow sight of the invention is simple in form and readily adaptable for mounting on a bow by a standard sight mount. The proper sight setting range is achieved by first establishing a low yard or meter setting by shooting a series of arrows at a short range target, followed by establishing a higher yard or meter setting also through the shooting of arrows at a long range target and by added sight adjustments. Once the low and high settings are established, intermediate yards or meters are readily determined from the scale.

A better understanding of the present invention will become more apparent from the following description, taken in conjunction with the accompanying drawings, wherein FIG. 1 is a view in front elevation of one form or archery bow sight in accordance with the teachings of the invention;

Figures 1, 2, 3, 5, 11:
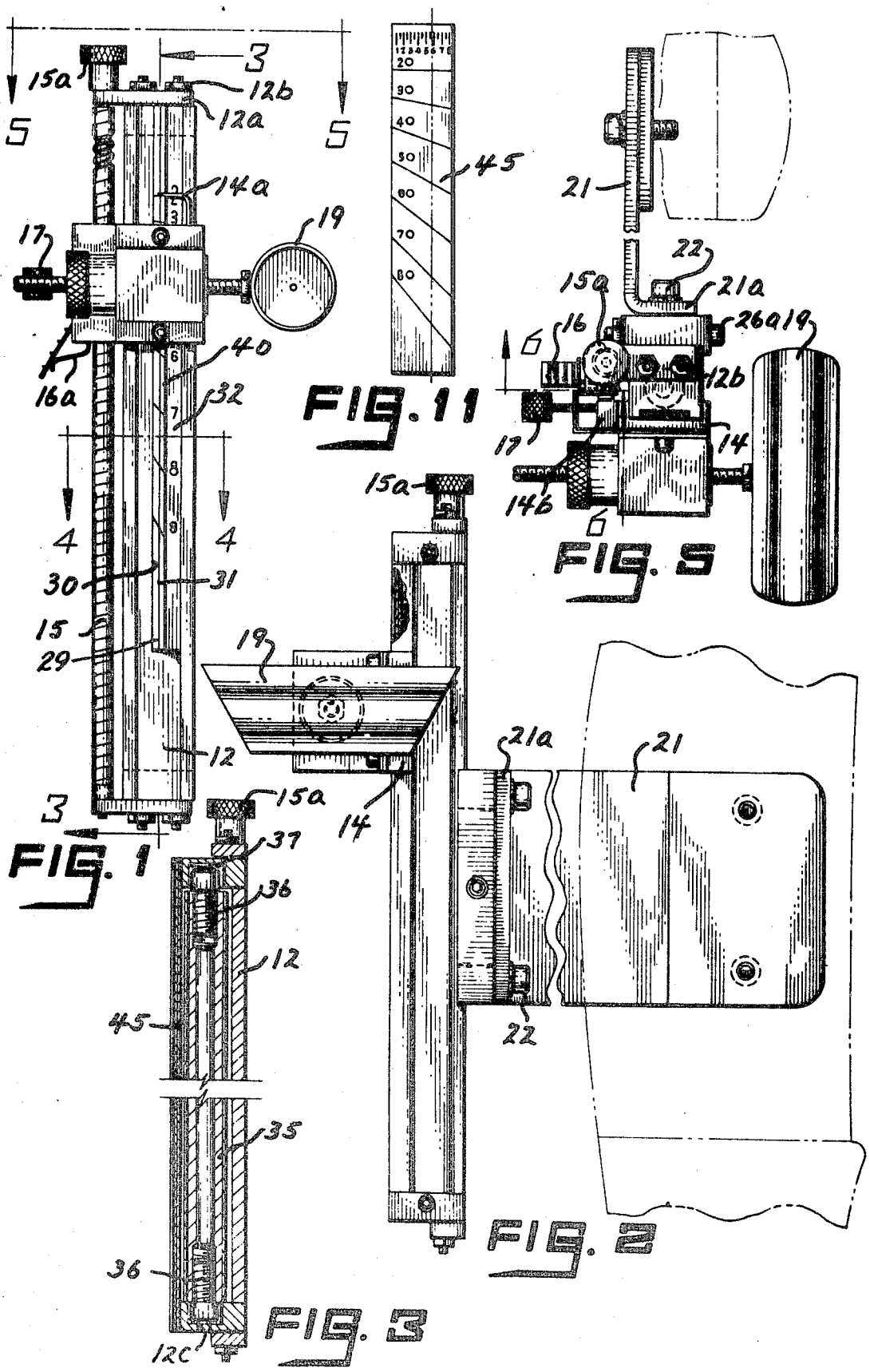
FIG. 2 is a view in side elevation showing the bow sight of FIG. 1 in position on a bow.
FIG. 3 is a view in vertical section of the operating mechanism taken at line 3—3 on FIG. 1 and, generally comparing to the view of FIG. 2, but with certain components omitted.
FIG. 5 is a top plan view of the invention, taken at line 5—5 on FIG. 1 and looking downwardly.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications of the illustrated devices, and such further applications of the principles of the invention as illustrated therein being contemplated as would normally occur to one skilled in the art to which the invention relates.

Referring now to the figures, and particularly to FIGS. 1 to 6, inclusive, the first form of bow sight to be described is that in which the cursor or index line is fixed and the scale lines are mounted on a rotatable cylinder disposed behind the cursor line. More specifically, the bow sight includes a housing 12 having caps 12*a* at opposite ends thereof positioned by nut means 12*b*. A block 14 is movable along the housing 12 by means of a rotatable adjustment screw 15 which extends between the caps 12*a* and through a projection on the block 14. The block 14 includes a pointer 14*a* extending from an upper surface thereof (see FIG. 1).

The rotation of adjustment screw 15 is typically accomplished manually by means of a knurled knob 15*a* at one end thereof, whereby a fine degree of control is achieved for the desired range setting selection. If, on the other hand, more rapid rotation is desired to move the block 14 from one setting to another, a pivotal quick release member 16 is provided, such being normally urged into a retaining position with the adjustment screw 15 by a spring 16*a* (see FIG. 6).

In other words, by pressing downwardly against the force of spring 16*a*, the quick release 16 member pivots away from the adjustment screw 15 and the latter is free to rotate at a rapid rate. As particularly evident in FIG. 5, a positive locking of the block 14 can be achieved through the use of a lock screw 17 which, upon tightening, serves to prevent block movement by screwing through a portion of 14*b* and bearing against housing 12.

As shown in FIGS. 1 and 5, the block 14 mounts a scope 19, but a sight pin (not shown) could also be employed in this connection. The scope 19 is mounted on the block 14 in a conventional manner, the specific details of which are not necessary for an understanding of the invention.

Figure 4:
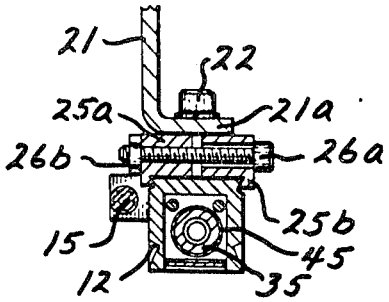
FIG. 4 is a view in horizontal section, taken at line 4—4 on FIG. 1 and looking in the direction of the arrows, showing details of the operating mechanism.
Figure 6:
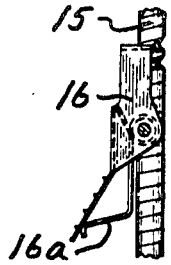
FIG. 6 is a view in side elevation of a control mechanism used in this invention embodiment, taken at line 6—6 on FIG. 5 and looking in the direction of the arrows.
Figure 10:
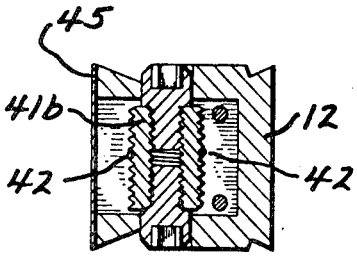
FIG. 10 is a view in horizontal section showing other details of the operating mechanism, taken at line 10—10 on FIG. 8 and looking in the direction of the arrows; and, FIG. 11 is a plan view of a sight scale employed in the practicing of the invention.
Figure 9:
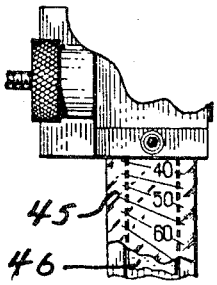
FIG. 9 is a fragmentary elevational view showing further details of the scale lines of the invention, comparing to a portion of FIG. 7.

Referring to FIGS. 2, 4 and 5, the bow sight is positioned on a bow (shown in phantom lines) by means of mounting bracket 21, the latter having an angled end portion 21*a* through which bolts 22 are secured to a slide block 23. The housing 12 is vertically adjustable on the slide block 23, where selective positioning is accomplished through the assembly more particularly shown in FIG. 4. In this connection, segments 25*a* and 25*b*, disposed between the upper and lower ends of the slide block 23 and encircling a screw 26*a*, are drawn together by means of screw 26*a* and maintained at the desired housing 12 position by the tightening of lockdown nut 26*b*.

With further reference to the housing 12, and to FIGS. 1 and 3, one face thereof includes an elongated slot opening into a cavity 29 within the housing 12. An index window 30 is disposed within the slot, where a cursor or index line 31 is scribed onto or otherwise presented on the face of window 30. A writing surface 32, such as a matte material, is disposed adjacent to the index window 30, and, in association with the pointer 14*a*, serves to permit the archer to make notations of the various shooting ranges which are established with the use of the bow sight, to be described herebelow. Normally, the only permanent number on the writing surface 32 is the numeral "2", representing a twenty yard or twenty meter target range.

A tubular member 35, typically made from hollow plastic material, is disposed between cap screws 36 which thread into the tubular member 35. The preceding assembly is placed within cavity 29, where further positioning is accomplished by a spring washer 37. In order to rotate the tubular member 35, a hex wrench (not shown) may be inserted through an opening 12*c* in the housing 12 and into operating contact with the lower cap screw 36. A sight scale 45, presenting a pattern of sloping sight lines (see FIG. 11), is secured to the outer surface of the tubular member 35, being visible through the index window 30 with the scribed cursor line 31.

FIGS. 7 to 10, inclusive, are directed to another form of bow sight in accordance with the teachings of the invention, i.e. an arrangement where the scale lines are fixed and the cursor or index line is movable behind the scale lines. In this connection, and at the outset, the housing 12, the block 14, the rotatable adjustment screw 15 for the block 14 and associated quick release member 16 and lock screw 17, the mounting bracket 21 for the bow, and the adjustment assembly for the housing 12 on the slide block 23, all remain the same as that described hereabove in connection with FIGS. 1 to 6, inclusive. Accordingly, and for purposes of ready understanding, the same reference numerals identify corresponding elements in each of the figures.

Figure 7:
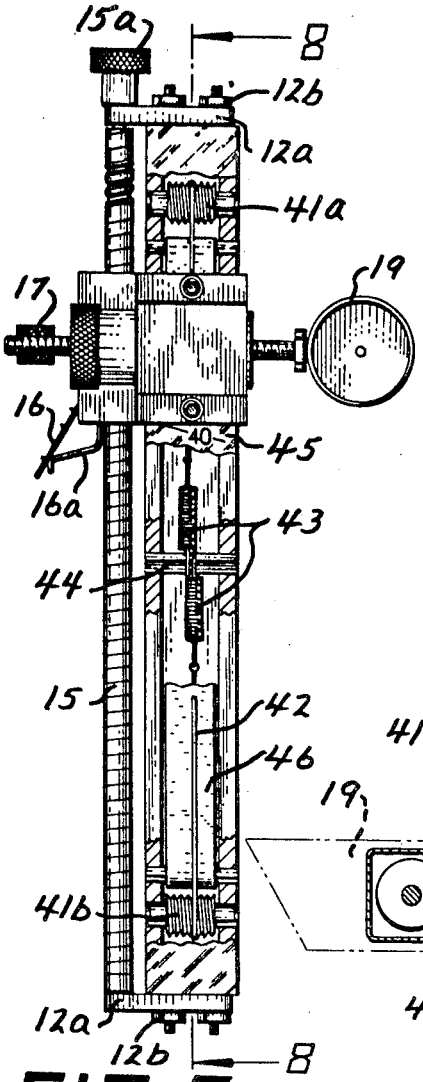
FIG. 7 is a view in front end elevation of another form of archery bow sight in accordance with the teachings of the invention.
Figure 8:
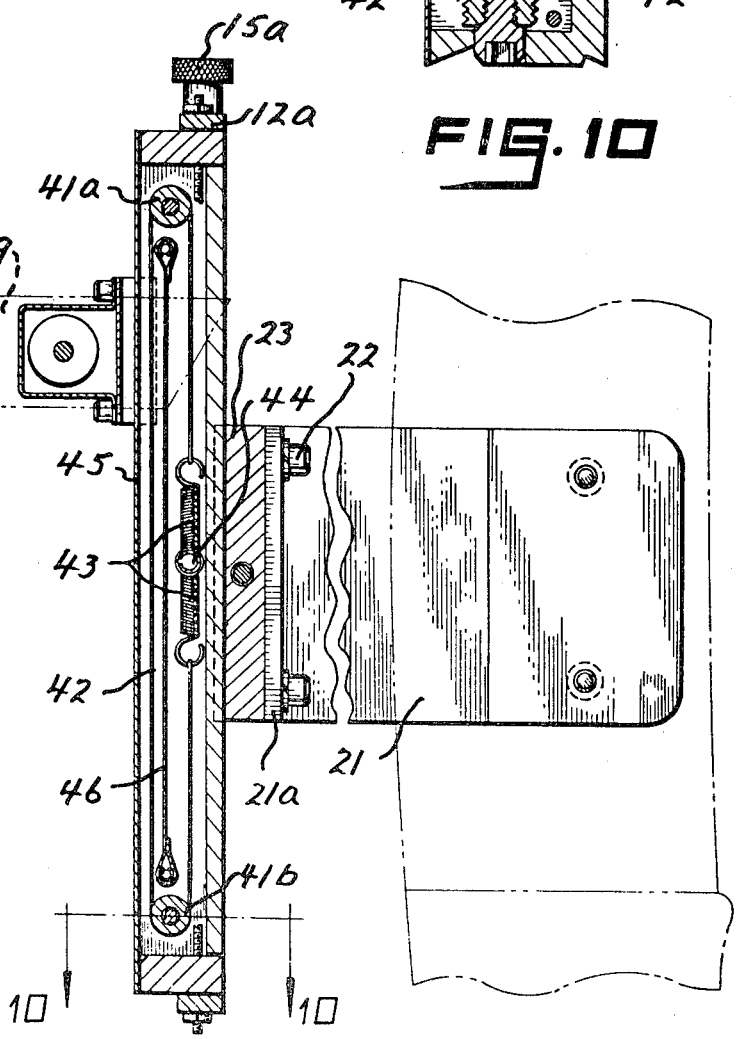
FIG. 8 is a view in vertical section of the bow sight of FIG. 7 positioned on a bow, taken at line 8—8 on such figure and looking in the direction of the arrows.

As particularly evident in FIGS. 7 and 8, the housing 12 mounts a drive worm 41*a* and a driven worm 41*b* (see FIG. 10), where the assembly further includes a movable cursor line 42, cursor line tension springs 43, and a cursor line anchor block 44. The cursor line 42 extends around the drive worm 41*a* and the driven worm 41*b*, where, upon rotation of the drive worm 41*a*, as by a hex wrench (not shown), the cursor line 42 moves back and forth in a lateral direction. As more apparent in FIG. 9, a flat transparent stationary scale 45, presenting a printed pattern of calculated sight distances, is disposed on the front of the housing 12. A tape 46 is disposed within the housing 12 behind the cursor line 42 and serves as a background for simplifying scale 45 reading.

As to the sight scale 45, such, detailed in FIG. 11, is representative of sight gaps or gap lengths for distances, typically, from twenty to ninety yards or twenty to ninety meters. A family of lines is calculated based on a minimum sight gap distance of 0.15 inch between twenty to thirty yards or twenty to thirty meters and a maximum sight gap distance of 0.48 inch between twenty to ninety yards or twenty to ninety meters. The calculation involves a 1.05 multiplying factor, raised to progressive powers, which accommodates for wind and gravity, reflecting the rate the arrow will deaccelerate after leaving the bow. A cursor line index scale is also provided on the sight scale 45, where a cursor line (31 or 42, depending upon the invention form) is shown in phantom in FIG. 11.

In use, and in the instance of either invention form, the block 14 is released through use of the lock screw 17 and moved along the housing 12 to range position 2 or 20 by the adjustment screw 15, i.e. the twenty yard or twenty meter setting which serves as a basis for the sighting procedure. The archer then shoots various arrows to a twenty yard or twenty meter target, vertically adjusting the assembled block 14 and housing 12 on the slide block 23 until the bow is shooting dead center for the twenty yard or twenty meter distance. At this time, the slide block 23 is locked into position by the tightening of lockdown nut 26*b*.

Thereafter, the block 14 is moved, typically, to approximate a sixty yard or sixty meter position, and additional arrows are shot to a sixty yard or sixty meter target. The block 14 is then moved upwardly or downwardly on the housing 12 until the exact sixty yard or sixty meter position is substantiated by the actual shooting.

At this time, in the instance of the invention form of FIGS. 1 to 6, inclusive, the tubular member 35 is rotated by a hex wrench in a direction to match the sixty yard or sixty meter sloping line on the sight scale 45 affixed thereto with the cursor line 31 at the position where the pointer 14*a* on block 14 indicates the actual shooting range. The remaining shooting ranges are then established, by written numerical notation on writing surface 32, i.e. effective arrow shooting can be achieved by moving the pointer 14*a* on block 14 to the desired shooting range line presented by reason of sight scale 45 and sighting through the scope 19.

In the FIGS. 7 to 10, inclusive, invention form, the drive worm 41*a* is rotated by a hex wrench to move the cursor or index line 42 behind the sight scale 45 until it intersects the sixty yard or sixty meter sloping line at the position where the pointer 14*a* (not shown in FIG. 7) on the block 14 indicates the actual correct location. Again, as in the other invention form, the remaining target ranges are thusly established.

From the preceding, it should be evident that the invention permits the instantaneous setting of sight markings by an archer through the use of a structure which is readily mounted on a conventional bow. Two different arrangements are provided to achieve the same end result, one involving a fixed cursor line and a rotatable sight scale, and the other involving a movable cursor line and a fixed sight scale. In the latter instance, the cursor line may be positioned in front of or behind the fixed sight scale. As stated heretofore, the instant bow sighting arrangement takes into consideration certain factors which play importance in effective shooting, as, for example, the weight and length of the arrow, thrust, form and the like.

The bow sighting arrangement and method is susceptible to various changes within the spirit of the invention, including proportioning, the use of alternative target viewing devices, material and others. Thus, the preceding description should be considered illustrative and not as limiting the scope of the following claims:

I claim:

1. A sighting mechanism for an archery bow comprising an elongated housing, a first block slidably mounted on said housing for longitudinal movement with respect thereto, a second block connected to said bow and slidably mounting said housing for longitudinal movement thereof, a sight scale carried by said housing and having a plurality of longitudinally spaced, non-parallel range lines, and a spaced apart longitudinally extending cursor line carried by said housing and visually intersecting the range lines of said sight scale, wherein one of said sight scale and said cursor line is mounted to be selectively movable in a transverse direction with respect to the other.

2. The sighting mechanism for an archery bow of claim 1, where said sight scale is fixed and said cursor line is transversely adjustable with respect to said sight scale.

3. The sighting mechanism for an archery bow of claim 2, where said cursor line extends between and travels along worm gears.

4. The sighting mechanism for an archery bow of claim 1, where said cursor line is fixed and said sight scale is cylindrically shaped and rotatably mounted.

5. The sighting mechanism for an archery bow of claim 1, where said first block mounts a target sighting device.

6. The method of sighting an archery bow which comprises the steps of establishing a first point of reference representative of the distance to a first target by means of positioning an indicating member associated with a sighting member longitudinally movable along an elongated housing connected to said bow at a predetermined location with respect to said housing, sighting the bow on said first target, correcting the position of said sighting member in response to sighting on said first target through relative movement of said housing and said bow, establishing a second point of reference representative of the distance to a second target by sighting the bow on said second target, establishing said indicating member at a position representative of the actual distance to said second target by movement thereof along said elongated housing, establishing other points of reference on said elongated housing representative of other actual distances between said first target and said second target using predetermined sighting relationships, and noting such actual distances on a writing surface positioned to cooperate with said indicating member.

* * * * *